US005375958A

United States Patent [19]

Klüttermann

[11] Patent Number: 5,375,958

[45] Date of Patent: Dec. 27, 1994

[54] APPARATUS FOR TRANSPORTING A COILER CAN BETWEEN A SLIVER PRODUCING AND AS SLIVER CONSUMING FIBER PROCESSING MACHINE

[75] Inventor: Jürgen Klüttermann, Mönchengladbach, Germany

[73] Assignee: Trützschler GmbH & Co. KG, Mönchengladbach, Germany

[21] Appl. No.: 20,088

[22] Filed: Feb. 19, 1993

[30] Foreign Application Priority Data

Feb. 19, 1992 [DE] Germany ..... 4204967

[51] Int. Cl.[5] ..... B65H 67/06

[52] U.S. Cl. ..... 414/225; 414/280; 414/751; 414/911; 57/281; 19/159 A

[58] Field of Search ..... 414/280, 525.1, 541, 414/661, 751, 225, 911; 57/281; 19/159 A

[56] References Cited

U.S. PATENT DOCUMENTS

| | | | |
|---|---|---|---|
| 3,598,265 | 8/1971 | Aaronson | 414/661 |
| 3,762,531 | 10/1973 | Lee | 414/280 X |
| 4,648,777 | 3/1987 | Eichenauer | 414/751 X |
| 4,683,619 | 8/1987 | Langen et al. | 19/159 A |
| 4,690,611 | 9/1987 | Nobuhara | 414/661 |
| 4,735,040 | 5/1988 | Pircher | 19/159 A X |
| 4,778,328 | 10/1988 | Apgar | 414/541 |
| 4,842,476 | 6/1989 | Shiotani | 414/751 |
| 4,998,406 | 3/1991 | Raasch | 57/281 |
| 5,138,828 | 8/1992 | Stahlecker | 57/281 |
| 5,158,417 | 10/1992 | Siegenthaler et al. | 57/281 X |

FOREIGN PATENT DOCUMENTS

| | | | |
|---|---|---|---|
| 0074549 | 3/1983 | European Pat. Off. | 414/751 |
| 0525448 | 2/1993 | European Pat. Off. | 57/281 |
| 2587043 | 3/1987 | France . | |
| 3626494 | 2/1988 | Germany . | |
| 3717957 | 12/1988 | Germany | 414/751 |
| 8812622 | 3/1990 | Germany . | |
| 0059104 | 4/1983 | Japan | 414/280 |
| 2181755 | 4/1987 | United Kingdom . | |
| 1252252 | 8/1986 | U.S.S.R. | 414/280 |
| 8606358 | 11/1986 | WIPO . | |
| 8904744 | 6/1989 | WIPO | 414/751 |
| 91/18135 | 11/1991 | WIPO . | |

*Primary Examiner*—Frank E. Werner
*Assistant Examiner*—James W. Keenan
*Attorney, Agent, or Firm*—Spencer, Frank & Schneider

[57] ABSTRACT

An apparatus for transporting a coiler can includes a carriage for receiving the coiler can and a loading and unloading device mounted on the carriage for shifting the coiler can toward or away from the carriage. The loading and unloading device has an elongated stationary base element secured to the carriage; and a plurality of elongated runners oriented parallel to one another and the base element. The runners are displaceable relative to one another and the base element. One of the runners—termed as a first runner—adjoins the base element and another runner—termed as a second runner—adjoins the first runner. The device further includes a guide arrangement for guiding the first runner on the base element and for guiding the second runner on the first runner. In extended positions the first runner partially projects beyond the base element and the second runner partially projects beyond the first runner. The device also has a drive for displacing the runners along linear paths and a gripping element mounted on one of the runners for engaging the coiler can and for shifting the coiler can upon displacement of the runners by the drive.

20 Claims, 6 Drawing Sheets

APPARATUS FOR TRANSPORTING A COILER CAN BETWEEN A SLIVER PRODUCING AND AS SLIVER CONSUMING FIBER PROCESSING MACHINE

CROSS REFERENCE TO RELATED APPLICATION

This application claims the priority of German Application No. P 42 04 967.9 filed Feb. 19, 1992, which is incorporated herein by reference.

BACKGROUND OF THE INVENTION

This invention relates to an apparatus for transporting a coiler can between a sliver producing fiber processing machine, such as a carding machine and a sliver consuming fiber processing machine, such as a drafting frame. The apparatus includes a carriage for transporting the coiler can. A coiler can loading and unloading device is mounted on the carriage for shifting the coiler can onto or off the carriage. The loading and unloading device has a gripping assembly for engaging the coiler can and a linearly displaceable shifting assembly for moving the coiler can relative to the carriage. The shifting assembly has a stationary holding element (also referred to as base element) and at least two movable holding elements which may be extended to assume positions beyond the stationary holding element.

In a known apparatus of the above-outlined type the loading and unloading device for the coiler can has two shifting (conveying) assemblies in a telescopic arrangement. Each assembly is formed of a stationary telescope cylinder and two movable telescope members, all coaxially movable into and out of one another. At the end of one movable telescope member an engagement element for the coiler can is arranged which is oriented at an angle of 90° to the telescope and which may be pressed against the coiler can.

It is a disadvantage of the prior art apparatus that the telescoping members are structurally expensive and further, the coiler can may be shifted only from one side out of or onto the carriage. It is a further drawback of the conventional apparatus that for the two telescoping assemblies separate driving devices are needed which also represents a significant expense. Furthermore, these structures require a labor-intensive maintenance.

SUMMARY OF THE INVENTION

It is an object of the invention to provide an improved apparatus of the above-outlined type from which the discussed disadvantages are eliminated and which, in particular, is of simple construction.

This object and others to become apparent as the specification progresses, are accomplished by the invention, according to which, briefly stated, the apparatus for transporting a coiler can includes a carriage for receiving the coiler can and a loading and unloading device mounted on the carriage for shifting the coiler can toward or away from the carriage. The loading and unloading device has an elongated stationary base element secured to the carriage; and a plurality of elongated runners oriented parallel to one another and the base element. The runners are displaceable relative to one another and the base element. One of the runners—termed as a first runner—adjoins the base element and another runner—termed as a second runner—adjoins the first runner. The device further includes a guide arrangement for guiding the first runner on the base element and for guiding the second runner on the first runner. In extended positions the first runner partially projects beyond the base element and the second runner partially projects beyond the first runner. The device also has a drive for displacing the runners along linear paths and a gripping element mounted on one of the runners for engaging the coiler can and for shifting the coiler can upon displacement of the runners by the drive.

The runners (sleds or carriages) according to the invention permit the provision of a structurally simple apparatus and further, the driven linear guide for the shifting assembly of the loading and unloading device may absorb high loads and is of rugged and compact structure.

The invention has the following additional advantageous features:

A common drive mechanism such as an electric motor is provided for displacing the runners.

The drive mechanism for moving the runners is mounted on the stationary holding element.

The driving device moves the runners with the intermediary of transmission elements such as toothed belts or chains.

On the base element a driven sprocket and an idler sprocket are supported. The driven sprocket is rotated by the drive motor. A toothed belt engages the two sprockets and is, at one end thereof, secured to one end zone and at another end to the other end zone of an adjoining runner.

On one runner a deflecting roller, such as a belt sprocket is supported which engages a transmission element such as a toothed belt whose one end is secured to an end zone of the adjoining base element or runner and whose other end is affixed to an end zone of an adjoining other runner.

The driving device for moving the runners is mounted on one of the runners.

The driving device for moving the gripping assembly, for example, an arcuate gripper, is mounted on the stationary holding element (base element).

The driving device for moving the gripping device is mounted on one of the runners.

The runners are simultaneously shiftable on a track. The gripping assembly is guided on a track and is movable during the displacement of the runners.

The runners are movable towards or away from the carriage on either side of the carriage.

The runners are of identical material and construction.

The runners are arranged in a side-by-side arrangement either in a vertical, superposed position or in a horizontal orientation.

DESCRIPTION OF THE PREFERRED EMBODIMENT

Figure 1:
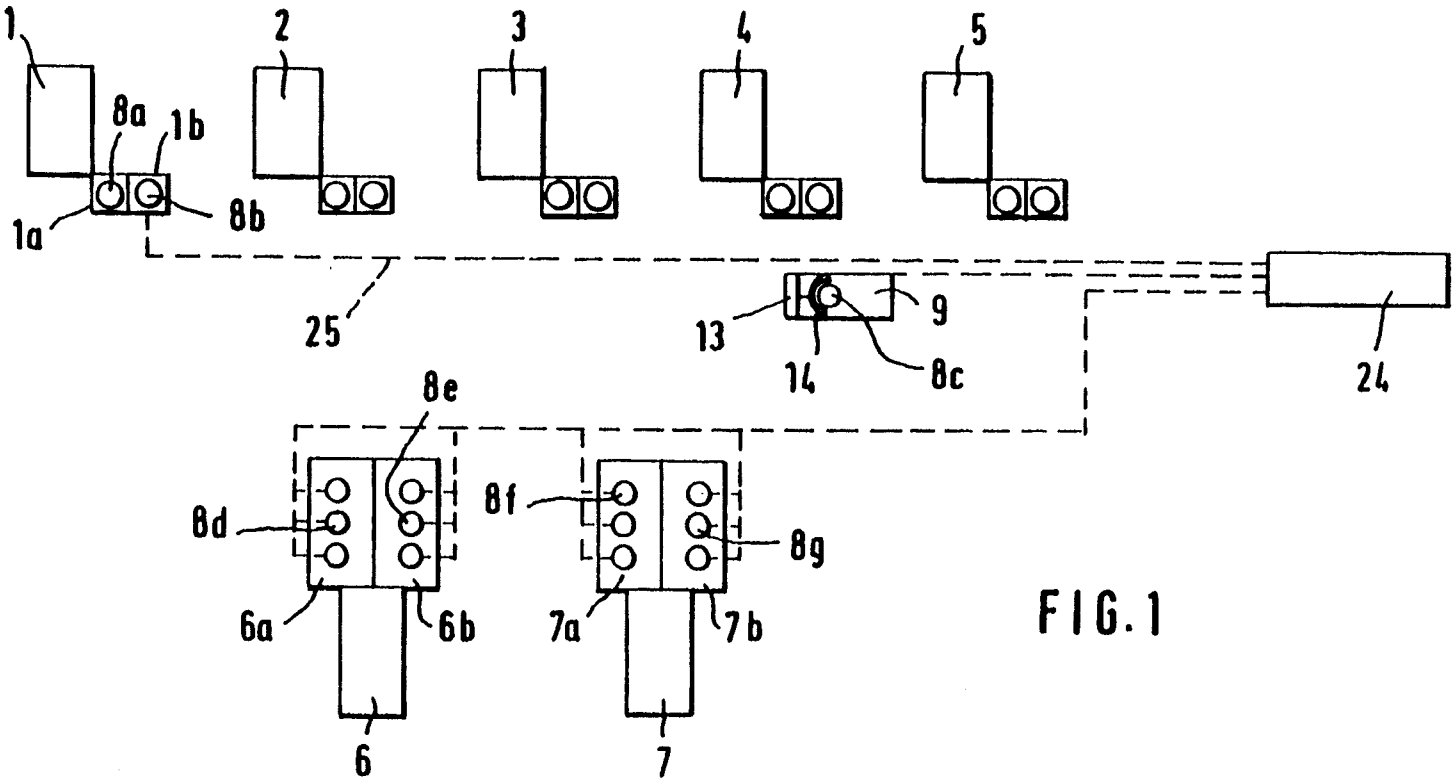
FIG. 1 is a schematic top plan view of a fiber processing system including five carding machines, two drafting frames and a coiler can transporting apparatus incorporating the invention.

Turning to the fiber processing (spinning preparation) system illustrated in FIG. 1, there are shown five carding machines 1, 2, 3, 4 and 5 and two drafting frames 6 and 7. Each carding machine 1–5—which may be EXACTACARD DK models manufactured by Trützschler GmbH & Co. KG, Mönchengladbach, Germany—has a feeding device (coiler) 1*a* to deposit sliver into a coiler can 8. Adjacent each feeding device 1*a* a pickup station 1*b* is arranged for receiving a coiler can 8*b* filled with sliver. The feeding device la and the pickup station 1*b* may be components of a conventional coiler can changer.

For transporting a coiler can 8*c* between the cards 1–5 on the one hand and the drafting frames 6, 7, on the other hand, a carriage 9 is provided which conveys the coiler can 8*c* to the storage station 6*a* of the drafting frame 6 or the storage station 7*a* of the drafting frame 7. The three coiler cans 8*d* in the storage station 6*a* and the three coiler cans 8*f* in the storage station 7*a* are at the same height level as the three coiler cans 8*e* in the intake station 6*b* of the drafting frame 6 and the three coiler cans 8*g* in the intake station 7*b* of the drafting frame 7. In the respective intake stations 6*b* and 7*b* sliver is pulled from the coiler cans 8*e* and 8*g* and admitted to the respective drafting frames 6 or 7 for doubling and drafting. It is to be understood that instead of three coiler cans 8*e* or 8*g* a greater or smaller number of coiler cans may be simultaneously placed at the intake 6*b* and 7*b* of the respective drafting frames 6 and 7 in case a different type of doubling is desired.

A reserve station 24 (coiler can "switching yard") is provided for the coiler cans 8. The reserve station 24 is situated between the carding machines on the one hand and the drafting frames on the other hand for accepting empty or full coiler cans 8. The travelling path 25 of the carriage 9 is indicated with a broken line. The carriage 9 has a loading and unloading device including a shifting assembly 13 according to the invention and to be described later, for handling the coiler cans 8 which may have a diameter of, for example, 1,000 mm.

Figure 2A:
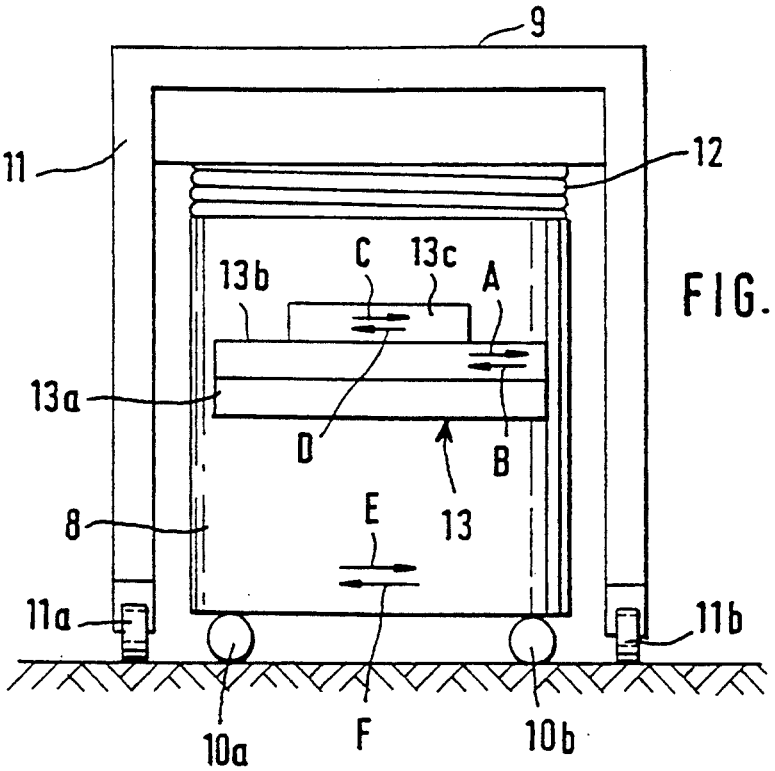
FIG. 2*a* is a schematic side elevational view of a preferred embodiment of the invention shown in a retracted position, including a base element and two runners in a vertically superposed arrangement.
Figure 2B:
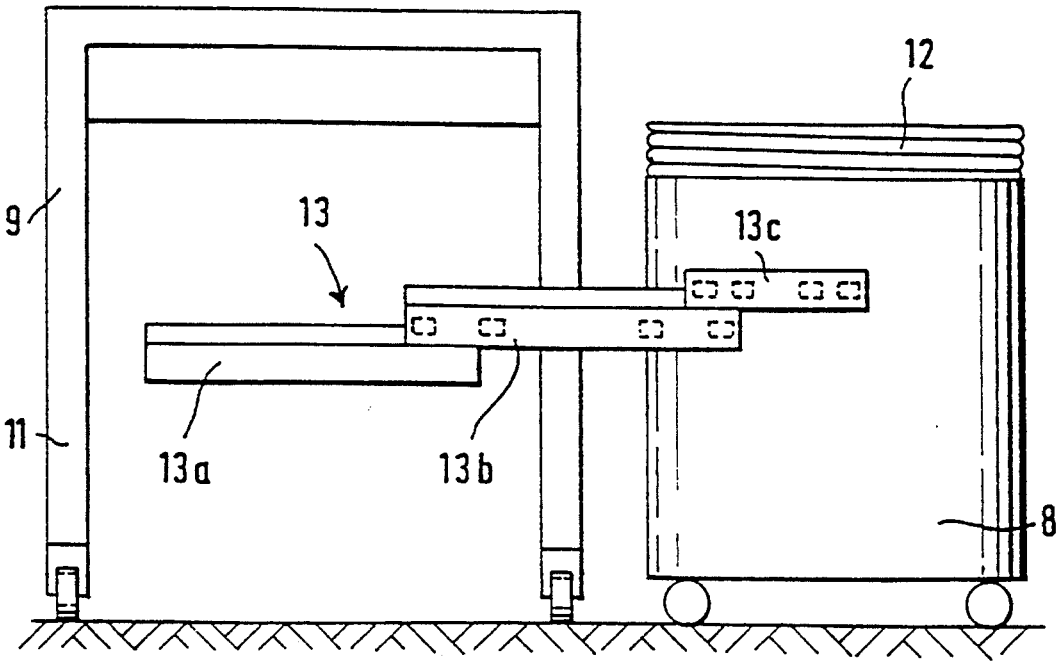
FIG. 2*b* is a view similar to FIG. 2*a*, showing the construction in a rightward extended position.

Turning to FIGS. 2*a* and 2*b*, there is shown the carriage 9 constructed to accommodate one coiler can 8 which is provided with ground-engaging casters 10*a*, 10*b* at its underside. On the frame 11 of the carriage 9 there are mounted drives such as a non-illustrated electric motor for driving the wheels 11*a*, 11*b* of the carriage 9, the drives for the shifting assembly 13 and the gripping element 14 (shown in FIG. 5), as well as energy supply devices and the like.

Figure 2C:
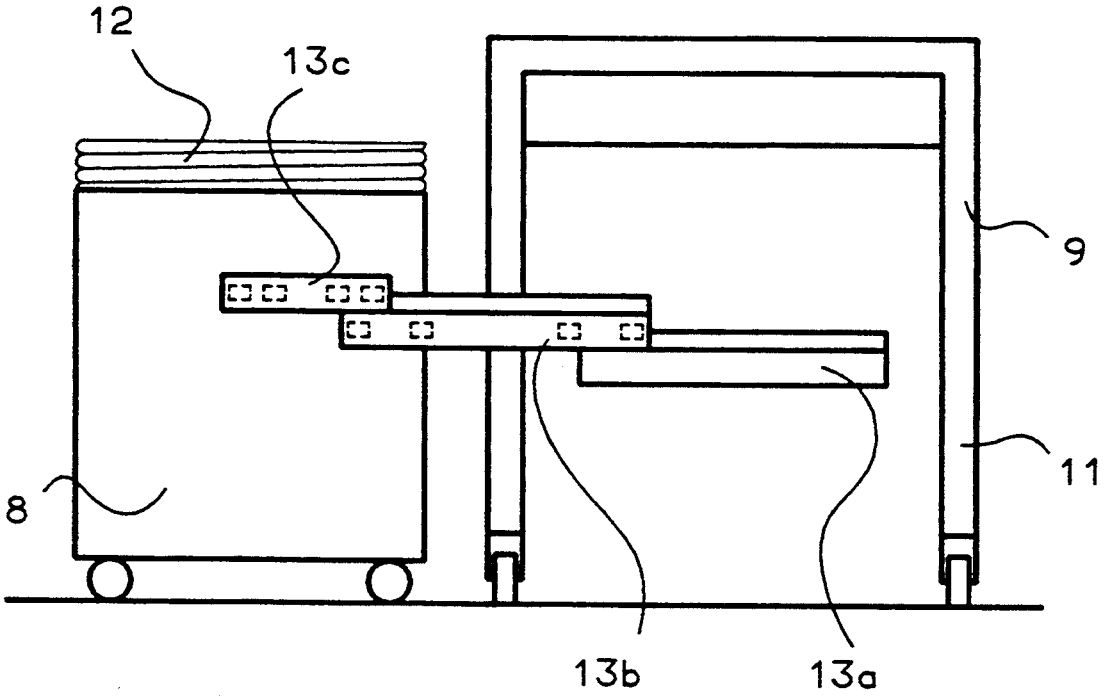
FIG. 2*c* is a view similar to FIG. 2*a*, showing the construction in a leftward extended position.

The shifting assembly 13 functions as a loading and unloading device for the coiler can 8. The shifting assembly 13 includes, in a superposed relationship, a stationary holding element (base element) 13*a* as well as two shiftable holding elements 13*b* and 13*c*, also termed as runners. For the purpose of securing the shifting assembly 13 to the carriage 9, the base element 13*a* is affixed to a wall, strut or the like of the carriage frame 11 in a non-illustrated, conventional manner. The runners 13*b* and 13*c* are movable horizontally and linearly as indicated by the arrows A, B as well as C, D. As shown in FIG. 2*a*, the coiler can 8 is situated within the carriage 9. In the illustration according to FIG. 2*b*, the coiler can 8 has been displaced laterally by the shifting assembly 13 to assume a position to the right of the carriage 9. It is to be understood that the coiler can 8 may also be displaced to the left of the carriage 9 in which case the shifting assembly 13 would be extended towards the left as shown in FIG. 2*c*. Thus, as will be described later in connection with FIG. 4, the shifting assembly 13 is so structured that it may selectively extend from the carriage 9 either to the right (FIG. 2*b*) or to the left (FIG. 2*c*). The sliver coil accommodated in the coiler can 8 is designated at 12.

Figure 3:
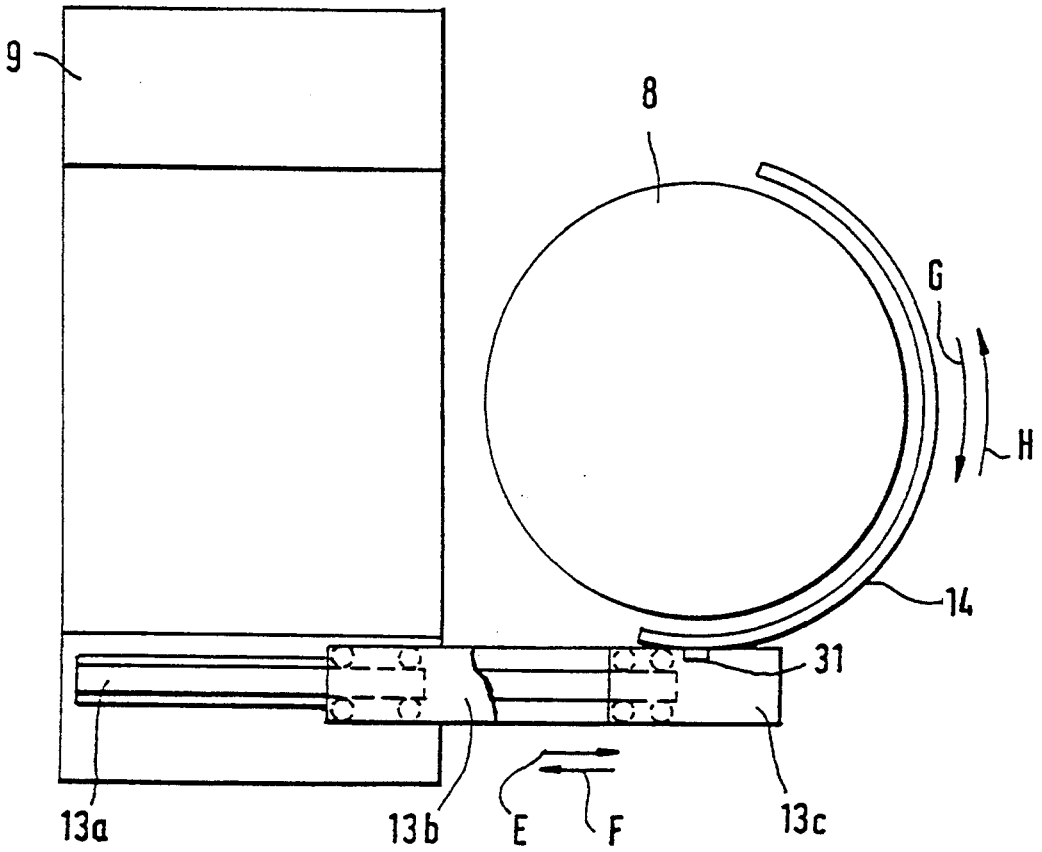
FIG. 3 is a schematic top plan view of the construction shown in FIG. 2*b*.

Turning to FIG. 3, the arcuate can-engaging gripping element 14 is laterally secured to the runner 13*c* and is movable in a circular path in the direction of arrows G and H parallel to the curved outer surface of the coiler can 8 as it will be explained later in conjunction with FIG. 5. By means of the gripping element 14 the shifting assembly 13 can move the coiler can 8 out of or onto the carriage 9, as indicated by the arrows E and F, respectively.

Figure 4:
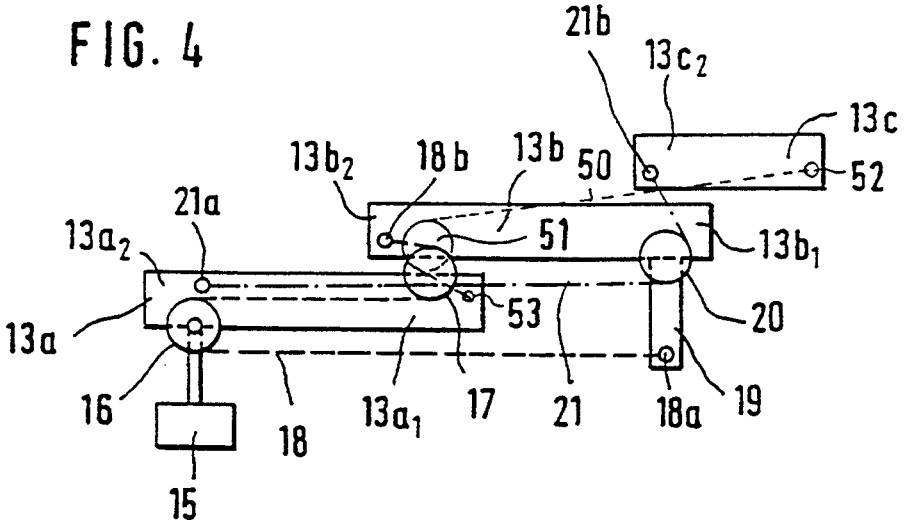
FIG. 4 is a schematic side elevational view of further details of FIGS. 2*a*, 2*b*, showing a drive mechanism for the runners.

Turning to FIG. 4, an electric motor 15 is mounted on the stationary element 13*a* to effect a horizontal, linear displacement of the runners 13*b* and 13*c*. The stationary element 13*a* also supports a toothed belt sprocket 16 which is situated in the zone $13a_2$ of the element 13*a* and which is rotated by the electric motor 15. In the zone $13a_1$ of the stationary element 13*a* an idling sprocket 17 is provided. A toothed belt 18 (primary drive) shown in dashed lines is trained about the sprockets 16 and 17. One end 18*a* of the belt 18 is secured by means of a connecting element 19 to an end zone $13b_1$ of the adjoining runner 13*b*, whereas the other end 18*b* of the belt 18 is affixed to the other end zone $13b_2$ of the adjoining runner 13*b*. A rotation of the driving sprocket 16 in the one or the other sense causes a linear motion of the runner 13*b* relative to the stationary element 13*a*. Further, for effecting a horizontal motion of the runner 13*c* relative to the runner 13*b*, a sprocket 20 is arranged at one end zone $13b_1$ of the runner 13*b*. A toothed belt 21 (secondary drive or pulling belt) shown in dash-dot lines is trained about the sprocket 20. One end 21*a* of the belt 21 is affixed to the end zone $13a_2$ of the stationary element 13*a* and the other end 21*b* of the belt 21 is secured to the end zone $13c_2$ of the runner 13*c*. Further, a belt 50 is provided which has one end 52 attached to the runner 13*c* at a location remote from the end 21*b* of the belt 21 and another end 53 attached to the base element 13*a* at a location remote from the end 21*a* of the belt 21. The belt 50 is trained about a sprocket 51 mounted on the runner 13*b* adjacent the end 18*b* of the belt 18. It is thus seen that the belts 21 and 50 are secured and supported in a mirror image to one another. These two belts will cause the runner 13c to follow the runner 13b as it moves towards the right (FIG. 2b) or towards the left (FIG. 2c). Thus, the belt 21 is effective upon extension of the runner 13b to the right and its retraction towards the left, whereas the belt 50 is effective upon extension of the runner 13b to the left and its retraction towards the right.

Figure 5:
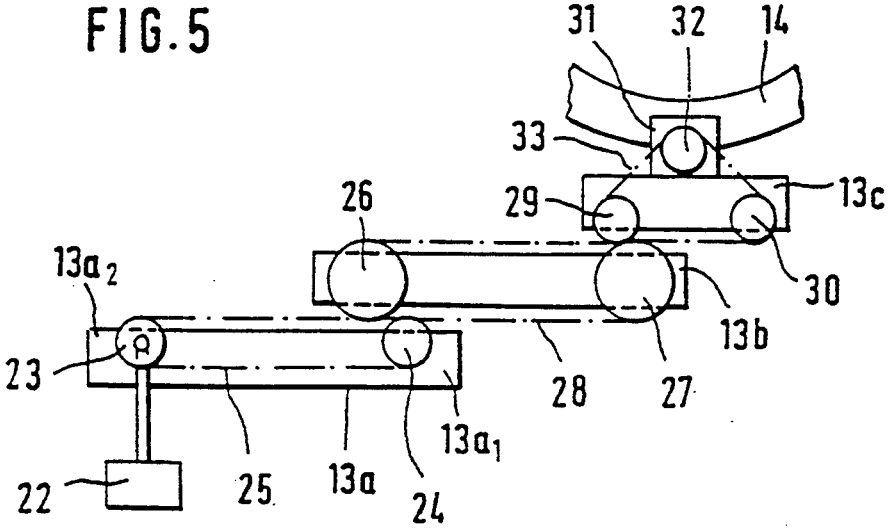
FIG. 5 is a schematic side elevational view of further details of FIGS. 2*a*, 2*b*, showing a drive mechanism for a gripping assembly.

Turning to FIG. 5, an electric drive motor 22 is mounted on the base element 13a for effecting a horizontal circular movement of the arcuate gripping element 14. In the respective end zones $13a_2$ and $13a_1$ of the base element 13a two toothed belt sprocket wheels 23 and 24 are mounted about which an endless, bilaterally toothed belt 25 is trained. The sprocket 23 is rotated by the electric motor 22. On the runner 13b there are supported two sprockets 26 and 27 about which a bilaterally toothed endless belt 28 is trained. The outer faces of the belts 25 and 28 are in engagement with one another. The runner 13c supports two sprockets 29, 30 which are arranged in the respective end zones $13c_2$ and $13c_1$ of the runner 13c. The runner 13c further supports a driving mechanism 31 to turn the gripping element 14 which carries a sprocket 32. An endless belt 33 which is toothed on both faces is trained about the sprockets 29, 30 and 33. The outer faces of the belts 28 and 33 mesh with one another. In this manner, the electromotor 22 can rotate the arcuate can gripping element 14 in any position which the runners 13b and 13c assume relative to one another. For the displacement of the runner 13b and 13c as well as for providing the motion of the gripping element 14 only two stationarily supported respective drive motors 15 and 22 are provided. The circular motion of the gripping element 14 along arrows G and H, that is, about the center of the arcuate element 14 may be effected by a drive belt attached at its two ends to the opposite ends of the element 14 and trained about a sprocket that is coaxial with the sprocket 32. The arcuate gripping element is held and guided by support rollers engaging the element 14 on opposite arcuate surfaces thereof. The support rollers are mounted on a base forming part of the driving mechanism 31. This type of drive is described in pending U.S. application Ser. No. 07/924,526 filed Aug. 4, 1992, now U.S. Pat. No. 5,228,551, and is incorporated herein by reference. By virtue of the circular mobility of the gripping element 14, the coiler can 8 may be engaged along its circumference at any desired orientation of the gripping element 14.

Figure 6:
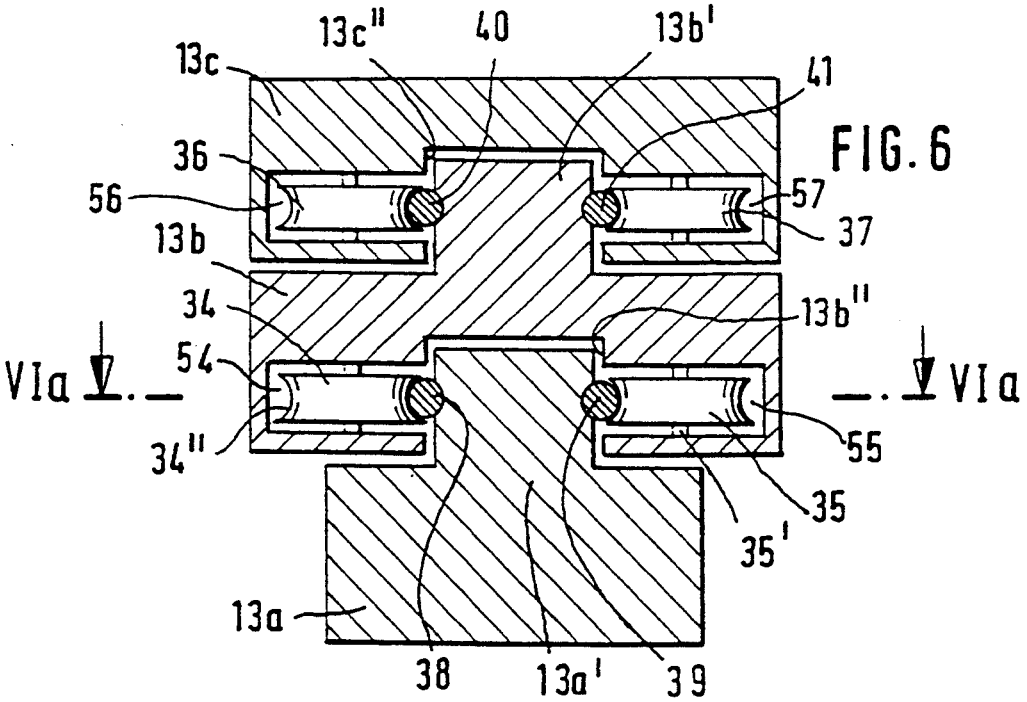
FIG. 6 is a sectional end elevational view showing the modular construction of a shifting assembly according to the invention.
Figure 6A:
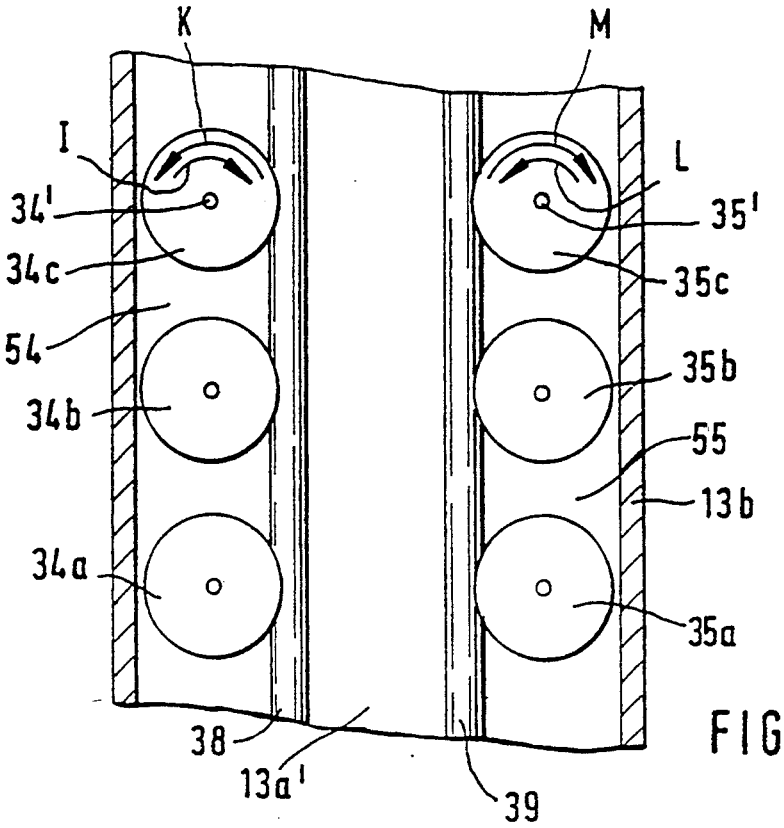
FIG. 6*a* is a sectional view taken along line VIa—VIa of FIG. 6.

Turning to FIGS. 6 and 6a, the stationary element 13a and the runners 13b and 13c are in a superposed arrangement. The elements 13a, 13b and 13c are expediently extruded profiled members and are mounted in a modular fashion. For forming a linear guide, the base element 13a has a rib 13a' along its length. The runner 13b has, on one face, a rib 13b' and is provided at its opposite face with a groove or channel 13b''. The runner 13c has a groove 13c''. The ribs 13a' and 13b' extend into the respective recesses 13b'' and 13c'' of the respective runners 13b and 13c. On both sides of each recess 13b'' and 13c'' there are provided more than two rollers 34, 35 and 36, 37, respectively, which are positioned in wells 54, 55 of the runner 13b and in wells 56, 57 of the runner 13c. The peripheral faces of the rollers 34–37 each have a concave configuration 34'' engaging guide elements 38–41, such as bars of circular cross section which are horizontally secured to opposite respective sides of the projections 13a', 13b'. The rollers 34–37 are rotatable about a vertical axis 34', 35' as indicated by the arrows I, K as well as L, M. In this manner the runners 13b and 13c form carriage-like wheeled members that run linearly on guide rods. It is to be understood that instead of rollers sliding surfaces may be provided in which case the runners 13b and 13c are sliding, sled-like elements.

Also, the runners 13b, 13c of FIG. 1 may be complemented with additional runners of identical construction to extend the range and/or to improve the stability of the shifting assembly 13. The elements 13a, 13b and 13c are preferably extruded aluminum profiles cut to the desired length.

Figure 7:
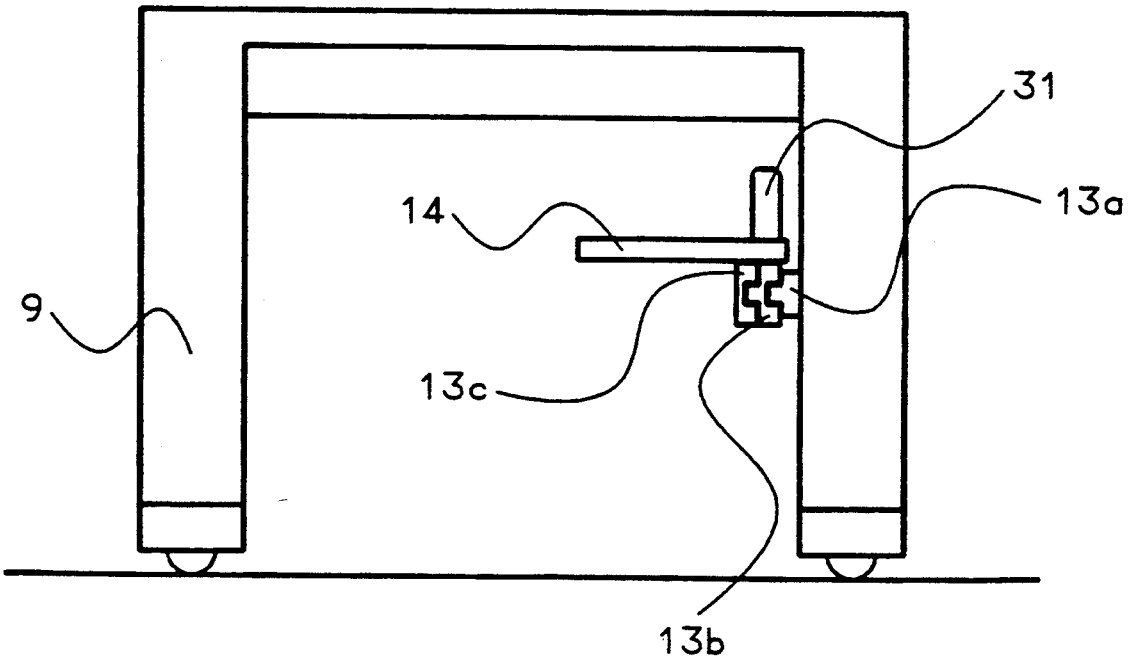
FIG. 7 is a schematic front elevational view of another preferred embodiment, including a base element and two runners in a horizontally adjoining arrangement.

While in the embodiment described above, the base element 13a and the runners 13b, 13c are in a vertically superposed arrangement, FIG. 7 illustrates the possibility of mounting these three components in a horizontally adjoining relationship.

It will be understood that the above description of the present invention is susceptible to various modifications, changes and adaptations, and the same are intended to be comprehended within the meaning and range of equivalents of the appended claims.

What is claimed is:

1. An apparatus for transporting a coiler can, comprising (a) a carriage for receiving the coiler can and for travelling with the coiler can; and (b) a loading and unloading device mounted on said carriage for shifting the coiler can toward or away from said carriage; said loading and unloading device including (1) a stationary base element secured to said carriage;

(2) a plurality of elongated runners oriented parallel to one another and the base element; said runners being displaceable relative to one another and relative to the base element along respective linear paths being parallel to length dimensions of said runners; one of said runners being a first runner adjoining said base element and one of said runners being a second runner adjoining said first runner; said first runner being situated between said base element and said second runner;

(3) guide means for guiding said first runner on said base element for displacement of said first runner in either direction along the linear path from said base element and for guiding said second runner on said first runner for displacement of said second runner in either direction along the linear path from Said first runner;

(4) drive means for displacing said runners from said base element in either direction along said linear paths to assume extended positions in which said first runner partially projects beyond said base element and said second runner partially projects beyond said first runner; and (5) a gripping means mounted on one of said runners for engaging the coiler can and for shifting the coiler can upon displacement of said runners by said drive means.

2. The apparatus as defined in claim 1, wherein said drive means comprises an electric motor.

3. The apparatus as defined in claim 1, wherein said drive means includes a motor mounted on said base element.

4. The apparatus as defined in claim 1, wherein said drive means comprises a motor and force-transmitting elements operatively coupling said motor to said runners.

5. The apparatus as defined in claim 1, wherein said drive means comprises (a) a drive motor;

(b) a first roller rotatably mounted on said base element and being driven by said drive means;

(c) a second roller rotatably mounted on said base element at a location spaced from said first roller; and (d) a belt having a first end attached to a first end zone of said first runner and a second end attached to a second end zone of said first runner; said belt being trained about said first and second rollers.

6. The apparatus as defined in claim 5, wherein said belt is a first belt; said drive means further comprising (e) a third roller rotatably mounted on said first runner at said first end zone thereof;

(f) a second belt having a first end attached to said base element at a location adjacent said first roller and a second end attached to said second runner; said second belt being trained about said third roller;

(g) a fourth roller rotatably mounted on said first runner at said second end zone thereof; and (h) a third belt having a first end attached to said base element at a location adjacent said second roller and a second end attached to said second runner; said third belt being trained about said fourth roller.

7. The apparatus as defined in claim 1, wherein said drive means includes a motor mounted on one of said runners.

8. The apparatus as defined in claim 1, wherein said drive means is a first drive means; further comprising a second drive means for moving said gripping means relative to the runner on which it is mounted; said second drive means includes a motor mounted on said base element.

9. The apparatus as defined in claim 1, wherein said drive means is a first drive means; further comprising a second drive means for moving said gripping means relative to the runner on which it is mounted; said second drive means includes a motor mounted on one of said runners.

10. The apparatus as defined in claim 1, wherein said drive means is a first drive means; further comprising a second drive means for moving said gripping means relative to the runner on which it is mounted; said second drive means includes (a) a motor;

(b) a force-transmitting mechanism mounted on said base element and being driven by the motor of said second drive means;

(c) two end rollers mounted on each runner at opposite end zones thereof and a separate endless belt supported by the end rollers on each said runner; the endless belt on said first runner being driven by said force-transmitting mechanism and the endless belts of said runners being in a face-to-face, force-transmitting contact with one another; and (d) a drive roller driven by the endless belt carried by the runner on which said gripping means is mounted; said drive roller moving said gripping means relative to the runner on which it is mounted.

11. The apparatus as defined in claim 10, wherein said force-transmitting mechanism comprises (a) two end rollers mounted on said base element; one of said end rollers of said force-transmitting mechanism being driven by the motor of said second drive means; and (b) an endless belt trained about the end rollers of said force-transmitting mechanism and being in a face-to-face, force-transmitting contact with the endless belt of said first runner.

12. The apparatus as defined in claim 1, wherein said drive means comprises means for displacing said runners simultaneously relative to one another.

13. The apparatus as defined in claim 1, wherein said runners are made of the same material.

14. The apparatus as defined in claim 1, wherein said runners are arranged side-by-side in a horizontal direction.

15. The apparatus as defined in claim 1, wherein said runners are arranged side-by-side in a vertical direction.

16. The apparatus as defined in claim 1, wherein said guide means comprises a rib formed on and extending along one of said runners and a channel formed in and extending along an adjoining runner; said rib extending into said channel.

17. The apparatus as defined in claim 16, further comprising a plurality of travel rollers mounted on the runner provided with said channel and being situated on either side of said rib for being at least indirectly engaged and guided by said rib.

18. The apparatus as defined in claim 17, wherein said guide means further comprises elongated guide elements fixedly mounted on opposite sides of said rib and extending along the runner provided with said rib; said travel rollers running on and-being guided by said guide elements.

19. The apparatus as defined in claim 18, wherein said elongated guide elements are formed of rods of circular cross-sectional outline; each said travel roller having a circumferential concave peripheral surface engaging said rods.

20. The apparatus as defined in claim 1, wherein said base element and said runners are extruded components.

* * * * *